United States Patent [19]

Pedersen

[11] 4,211,433

[45] Jul. 8, 1980

[54] TWIN SKI

[75] Inventor: Alec Pedersen, Vancouver, Canada

[73] Assignee: Pedersen Industries Ltd., Vancouver, Canada

[21] Appl. No.: 926,818

[22] Filed: Jul. 21, 1978

[51] Int. Cl.[2] ..... A63C 5/00

[52] U.S. Cl. ..... 280/601; 280/609

[58] Field of Search ..... 280/607, 609, 601, 610, 280/11.37 E, 16, 12 H; 9/310 C, 310 B, 310 AA

[56] References Cited

U.S. PATENT DOCUMENTS

| | | | |
|---|---|---|---|
| 2,841,805 | 7/1958 | Roudebush | 9/310 C |
| 3,854,738 | 12/1974 | Fish | 280/607 |
| 3,862,764 | 1/1975 | Hartz | 280/11.37 E |
| 3,947,049 | 3/1976 | Pedersen | 280/607 |
| 4,027,895 | 6/1977 | Larsson | 280/607 |

FOREIGN PATENT DOCUMENTS

| | | | |
|---|---|---|---|
| 94867 | 10/1959 | Norway | 280/609 |

*Primary Examiner*—David M. Mitchell

*Attorney, Agent, or Firm*—Fred Philpitt

[57] ABSTRACT

A monoski is provided herein having an integral mononose section which is preferably made of exceptionally strong material to resist twisting, the integral mononose section including an upwardly curved tip, and bifurcated tail sections separated by a longitudinal slot, with particularly disclosed ratios of widths of the mononose and of the slot. Bindings are provided for securement on each of the tail sections of the monoski adjacent the central waist portion. Bridge means are provided at the tail section adjustably and floatingly holding the tail segments in predetermined spaced apart relation, so that the lateral spacings are predetermined, but yet the tail segments are allowed to move vertically. The ski has extremely good manoeverability, good pivot turnability, controlled turns at substantially all speeds, good support on powder snow and excellent manoeverability in both packed and corn snow. The four edges provide greater control and the interconnected tail section work independently.

39 Claims, 18 Drawing Figures

TWIN SKI

(A) BACKGROUND OF THE INVENTION (i) Field of the Invention

This invention relates to a monoski, namely, a single ski which is adapted to support both feet of a skier. More particularly, it is an improvement over the monoski disclosed in U.S. Pat. No. 3,947,049 issued Mar. 30, 1976, to Alec Pederoen.

(ii) Description of the Prior Art

Monoskis have been disclosed in the past in, for example, in U.S. Pat. No. 3,154,312 patented by Jacques Marchand on Oct. 27, 1964. The ski provided therein was one where it was essential to secure a pair of boot fasteners to the ski proper so that they would be directly over the ski and also would be alongside each other. It was also found to be essential that such bindings not extend beyond the sides of the ski, at least not substantially.

Another improvement in monoskis was provided in U.S. Pat. No. 3,758,127 patented by Michael D. Doyle and William L. Bahne, on Sept. 11, 1973. The single ski described in that patent was much wider and shorter than conventional skis. Both feet were held in close side-by-side position in any suitable type of bindings or boot retainers, the constant secure leg position making control more positive. In such patented monoski, the central body portion was very stiff, the tail was torsionally flexible and the nose or tip was even more flexible. Very little bottom camber was used and the ski did not have the pronounced hourglass shape used in most conventional skis to allow a tight radius turn. The patented ski has almost straight sides for high speed and stability, yet was said to be capable of sharp turns due to its novel design. The patented ski had a length-to-width ratio on the order of 9 or 10 to 1.

In another prior patent, namely, U.S. Pat. No. 3,685,846 patented by Hans Schmid on Aug. 22, 1972 improvements were provided in such monoskis of the kind in which a single conventional ski body member, formed with a gliding surface, was provided with two ski bindings fixed on the ski body member in side-by-side arrangement, each binding having a toe portion and a heel portion.

A novel construction of a monoski was provided in that patent which the components supporting the toe and heel portions of the ski binding were so formed that the ski body portion provided with the gliding surface allegedly did not have any rigid waist portion. A support was provided for the toe portion, and a support was provided for the heel portion. The two supports were fixed one behind the other in longitudinally spaced relation on the ski body. Furthermore, the ski-boot supporting surface on the toe and heel portions of the binding was raised a distance above the ski body member corresponding substantially to the width of the ski.

Another improvement in monoskis was provided in U.S. Pat. No. 3,802,714 patented by Stephen D. Freegard on Apr. 9, 1974. In that patent a deck structure was provided which could be added to one of a conventional pair of skis so that the single ski could be used as a monoski. Thus, the deck structure included a two-part pedestal, the parts of which were relatively reciprocable in one vertical plane of the pedestal, and adapted to be superposed on a ski and interengaged with the bindings thereof. The deck structure also included a two-part platform which was mounted on the pedestal to support the skier. The parts of the platform were also relatively reciprocable in the vertical plane of the pedestal, so that the binding on the parts of the platform, adjacent the upper surface thereof could be interengaged with the boots of the skier. When the parts of the pedestal were interengaged with the bindings of the ski, the parts of both the pedestal and the platform were fixed in relation to one another.

While monoskis as above described were useful in powder snow, they were most difficult to control and to use in hard-packed or corn snow.

In an effort to provide a new and improved single ski on which both feet were held in close side-by-side relation, and a new and improved single snow ski which was easily controlled and safer to use than conventional dual skis, not only in powder snow, but in hard packed or corn snow, the monoski of U.S. pat. No. 3,947,049, issued Mar. 30, 1976, to Alec Pedersen was developed. According to that patent, a single snow ski was provided comprising: an elongated body having a central waist portion, having a maximum width of $6\frac{1}{4}''$, an upwardly curved forward tip region, having a maximum width of $6\frac{1}{2}''$, and an upwardly tapered and outwardly flared tail portion, having a maximum width of $7\frac{1}{3}''$, the ski having its greatest thickness at the central waist portion, and being reduced in thickness both towards the tail portion and the forward tip region, the minimum thickness being adjacent the forward tip region, and wherein the forward tip region defined by side edges flaring outwardly from the central waist portion towards the forward end of the ski, and then converging to join together at the tip, such forward tip region being wider than the central waist portion, and wherein the tail portion is wider than the forward tip region; wherein the ratio of the width of the tip to the width of the waist is 1.04–1.23 and wherein the ratio of the width of the tip to the width of the tail is 0.77–0.93 and ski bindings mounted on the ski adjacent the central waist portion for holding the feet of a skier in close side-by-side relation, with such ski bindings extending slightly over the side edges of the ski.

While the monoski described above was superior to monoskis proposed in the past, it was found desirable to effect further improvements.

(A) SUMMARY OF THE INVENTION (i) Aims of the Invention

Accordingly, objects of this invention include the provision of an improved monoski which includes a wider stance for balance, is adaptable to virtually all snow conditions, is lighter in overall weight and is easier to use.

(ii) Statement of Invention

By this invention a twinski is provided comprising: a mononose section and bifurcated tail sections separated by a longitudinal slot, the tail sections being at least five times as long as the nose section, the nose section including an upwardly curved forward tip region, the tail sections including a pair of central waist segments comprising a central waist portion, and a pair of terminal tail segments comprising a tail portion, the twinski having its greatest thickness at the central waist portion, and being reduced in thickness both towards the tail portion and the forward tip, the minimum thickness being adjacent to forward tip region; ski bindings adapted to be mounted on each of the tail sections of the ski adjacent the central waist portion for holding the feet of a skier in close side-by-side relation; and bridge means at the tail portion adjustably and floatingly holding the tail sections in predetermined spaced apart relation, so that the lateral spacings are predetermined, but yet the tail sections are allowed to mover vertically.

(iii) Other Features of the Invention

By one feature of this invention, the bridge means comprises a connector plate secured to the end of each of the tail portions and a single continuous curved connecting rod secured at its ends to a respective one of the connector plates.

By another feature, each end of the connecting rod is pivotally connected to its respective connector plate.

By another feature, the bridge section means comprises a connector plate provided with an upstanding post secured to the end of each of the tail portions, and a connector bar interconnecting the upper ends of the upstanding posts.

By another feature, the connection between the connector bar and the upper end of each upstanding post is a universal joint to provide pivotal movement.

By another feature, the connecting bar or rod is formed of tension steel.

By still another feature, the connector bar or rod is adjustable in length to provide controlled spacing between the ends of tail portions.

By another feature, the bridge means is secured to the tail section by a bottom plate, substituting for a portion of a lower skin of the monoski, and an upper plate substituting a portion of the upper skin of the monoski.

By another feature of this invnetion, the bridge means comprise a connecting bar of semi-hooplike shape provided with an aperture therethrough at each end, whereby the connecting bar may be connected to spaced apart ears in one of the plates, by means of a pin extending through aligned apertures in the ears and the connecting bar.

By a further feature, the upper plate is secured to the lower plate by a bolt, passing through the upper plate, the ski core and tapped holes in the lower plate.

By still another feature, the upper plate is provided with a pair of spaced apart ears, having aligned apertures, a connecting bar disposed between the ears, the connecting bar having an aperture therethrough at the lower end; and a pin extending through all said apertures to provide hinged connections.

By another feature, the lower plate is provided with a pair of upstanding, spaced apart ears, which project through the ski and the upper plate the ears having aligned apertures, a connecting bar disposed between the ears, the connecting bar having an aperture therethrough at the lower end; and a pin extending through all said apertures to provide hinged connections.

By still another feature, the connection bar is provided with a protective wrapper.

By a further feature the twinski includes a groove in the base of each of the tail section.

By another feature, the twinski has a camber of about ½" to about 3/5".

By a further feature, the bindings extend from about ¼" to about ½" over the side edges of the twinski.

By another feature the total width of the tail (i.e. the width of the two tail segments and the width of the slot) may be the same, or wider than the width of the tip at the mononose section.

By another feature of this invention, the width of the longitudinal slot is the same as the width of each of the tail sections.

By another feature, the twinski may be from about 41" to about 92".

By other features, the monoski may be about 80" long with the integral mononose section being about 20" long; or it may be about 80" long, with the integral mononose section being about 18" long.

By further features thereof, the slot can be about from 60" to about 75" long, desirably either about 68" or about 61" long.

By still other variants, the slot may converge from about 2½" at the tail to about 2" cm at the mononose; or from about 4" at the tail to about 2¼" at the mononose.

By still another feature, each bifurcated tail section may be wider than the slot, at the tail.

By still another feature, the slot converges from the tail to the integral mononose, and especially where the degree of convergence increases at the integral mononose.

By another feature, the integral mononose section is formed of exceptionally strong material to resist twisting moments of the tail sections.

By another feature the bindings include a pair of toe members mounted parallel to one another on individual base plates, each such base plate secured directly onto a respective tail section of the ski, and a pair of heel members mounted parallel to one another on individual base plates, each such base plate being secured directly onto a respective tail section of the ski.

By another feature of this invention, the twinski is formed of a foam core, with stiffening members of wood, and laminated to a glass fiber sheet, and a synthetic plastics material of the bottom, running surface.

By a further feature of this invention, the twinski is formed of a laminate of hickory, ash, and glass fiber, with an upper laminated surface of airplane aluminum, and a bottom running surface of a synthetic plastics material.

By yet another feature of this invention, the twinski is formed of a honeycomb core, either of a plastic material, or a metal, e.g. aluminum laminated to a glass fibre sheet or to a sheet of airplane aluminum and a running surface of a synthetic plastic material.

By a further feature, the twinski includes four steel running edges along the edges of the tail sections of the monoski.

BRIEF DESCRIPTION OF THE DRAWINGS

In the accompanying drawings.

DETAILED DESCRIPTION OF THE INVENTION

Figure 1:
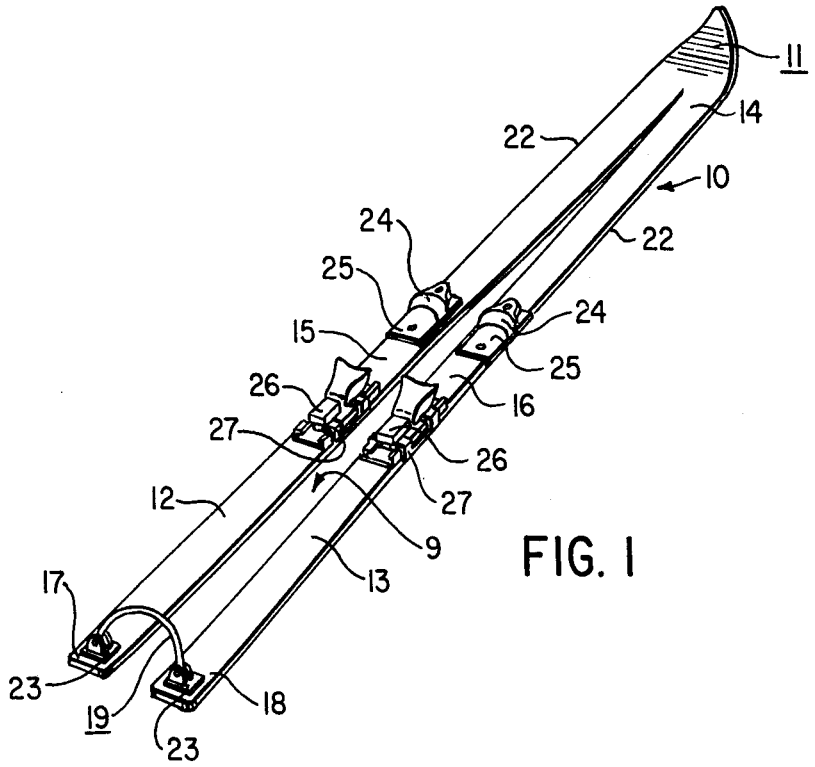
FIG. 1 is a perspective view of a twinski according to this invention.
Figure 2:
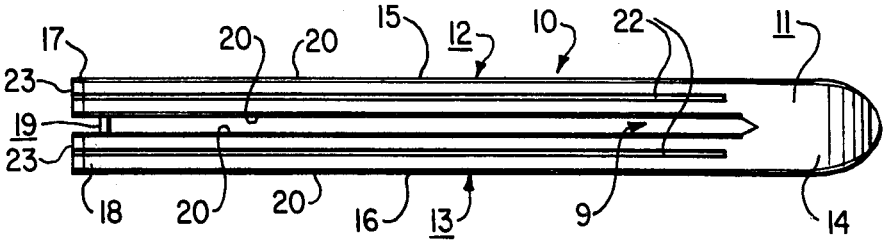
FIG. 2 is a bottom plan view of the twinski of FIG. 1.
Figure 3:
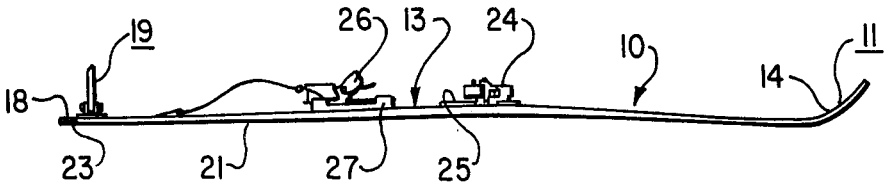
FIG. 3 is a side elevational view of the twinski of FIG. 1.

Descriptions of FIGS. 1, 2 and 3

Turning to FIGS. 1, 2 and 3, it is seen that the twinski 10 comprises an elongated body having an integral mononose 11 and a bifurcated pair of tail sections 12, 13 separated by a slot 9. The twinski 10 includes an upwardly curved forward tip region 14 and a pair of central waist segments 15, 16 providing a central waist portion, and a pair of preferably outwardly flared tail segments 17, 18 providing (preferably) an outwardly flared tail portion. The tail segments 17, 18 are tied together in a "floating" manner to be described hereinafter by tail bridge structure 19. Each of the four side edges may be provided with a conventional steel wear resistant edge 20. The underside of the ski has a running surface 21 of polyethylene, or a similar plastic material, desirably having a longitudinal groove 22 extending from adjacent the forward tip 11 along substantially the full length of the body of each tail segment 12, 13. Grooves 22 allow the twinski to unstick from the snow more readily and to reduce friction in running. The tail portion of the twinski is slightly upwardly tapered and preferably the tail segments 17, 18 may be protected by a reinforcing strip 23 of metal or the like.

The feet of the skier are held in side-by-side position on the central waist segments 15, 16 of the monoski 10 by any suitable bindings or boot retainers, represented as toe grips 24 mounted on binding plates 25 and heel clamps 26 mounted on binding plates 27. Many different bindings and quick release fittings are available, and since they do not form part of this invention need not be discussed further. Suitable securing means can be incorporated on the twinski 10 where needed.

The turning characteristics of the twinski are altered from that of normal skis. Such characteristics become superior, and it is possible to effect turns uphill more smartly, faster and with greater safety, and to effect turns downhill to the fall line with equally smooth characteristics.

The bindings 24, 26 may be set side-by-side or may be moved, one slightly ahead of the other. It is preferred, however, that the bindings 24, 26 be set parallel to each other, equidistant from the forward tip 11 and the tail segments 17, 18.

The twinski 10 is simple to ride, and with both feet held fairly close together there is no tendency for the feet to separate and get out of control in extreme manoeuvers. Very tight pivot turns can be made at substantially any speed without any substantial loss of stability. The turning radius can be as little as one third of that possible with conventional dual skis. The wide area enables the twinski 10 to plane effectively and to ride high in soft snow, which also facilitates maneuvering. In a fall, the risk of injury is greatly reduced, since the feet do not fly in different directions, each with a long unwieldy ski attached.

It is believed that the likelihood of injury in the case of the use of the twinski 10 is reduced because the legs are held fairly close together. The majority of accidents result from crossed or diverging skis, with or without proper bindings. Preferred bindings are side release bindings of the safety type. They should be set 30 to 40% looser than is the usual practice. In test falls, a skier has been found to come down without discomfort in a sitting position. It is believed that this is due to the characteristics of the twinski in unusual attitudes, and the weight of the skier is essentially towards the rear.

Figure 4:
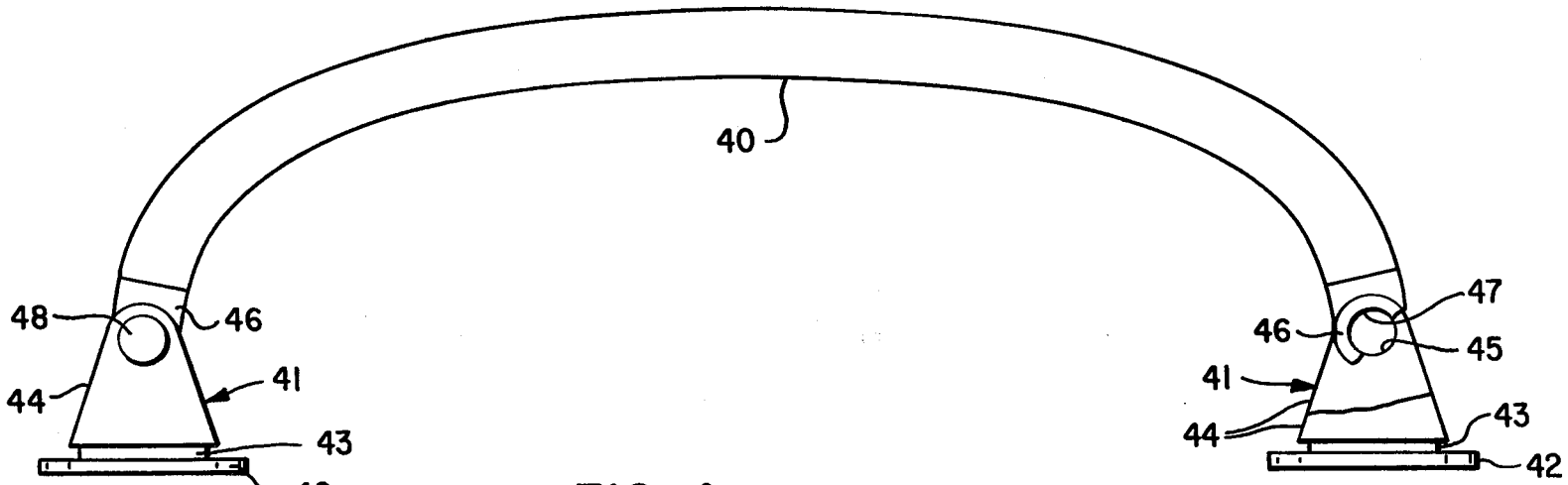
FIG. 4 is a side elevational view of one embodiment of the tail bridge structure used in the twinski according to this invention.
Figure 5:
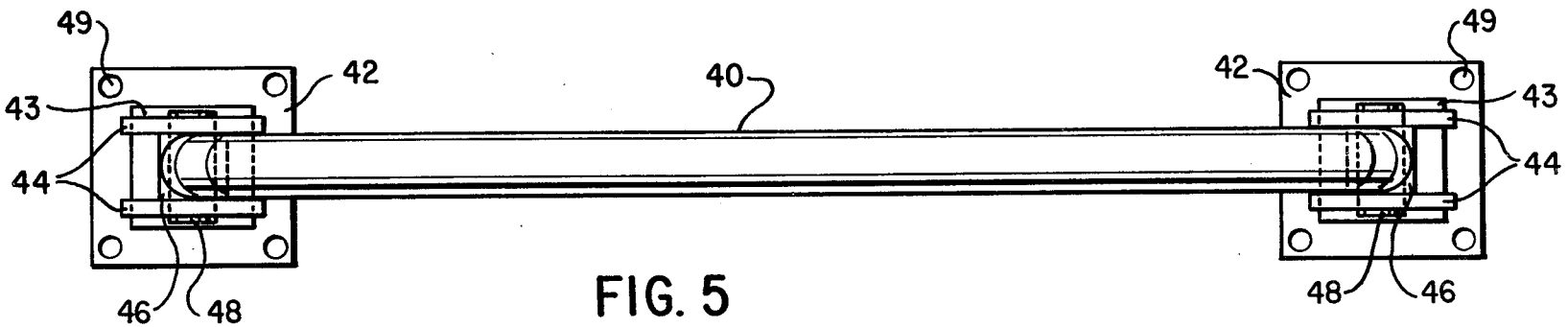
FIG. 5 is a top plan view of the tail bridge structure of FIG. 4.

Description of FIGS. 4 and 5

Turning now to FIGS. 4 and 5, the tail bridge structure 19 comprises a curved tensile steel bar 40 disposed between two retaining members 41. Each retaining member includes a generally rectangular base plate 42 having a support base pedestal 43 thereon. Upstanding from pedestal 43 are a pair of spaced apart lugs 44 provided with aligned apertures 45. The end plugs 46 of bar 40 are also provided with apertures 47. A hinge pin 48 is mounted through aperture 47, 45 to provide a hinged connection between the base 42 and the bar 40, to allow "floating" interconnection.

Base plates 42 are provided with fastening apertures 49 to permit securement of the base plate 42 to the tail segment 17, 18 of the monoski.

Figure 6:
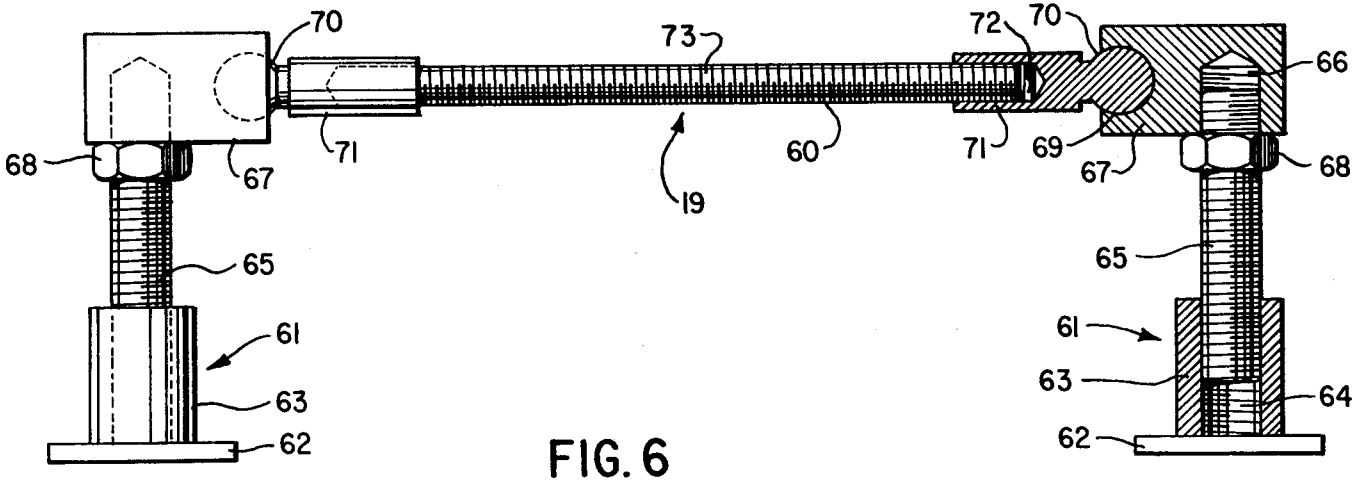
FIG. 6 is a side elevational view of another embodiment of the tail bridge structure used in the twinski of this invention.
Figure 7:
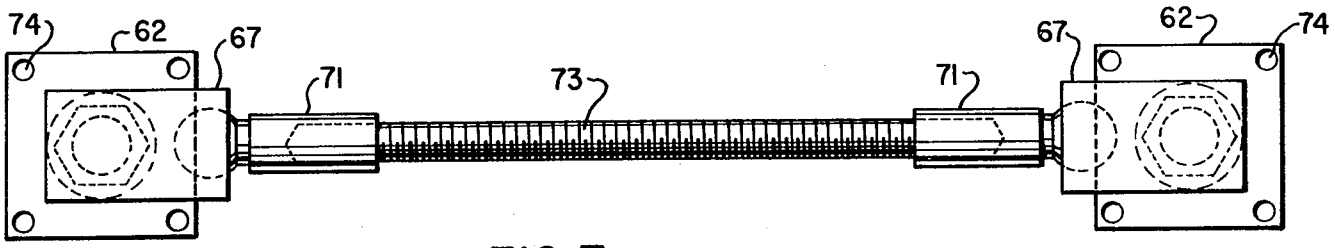
FIG. 7 is a top plan view of the tail bridge structure of FIG. 6.

Description of FIGS. 6 and 7

Turning now to FIGS. 6 and 7, a second variant of a tail bridge structure 19 is shown. It includes a horizontal bar structure 60 and a pair of vertical pedestal structures 61. Each pedestal structure includes a plate 62 with an upstanding cylindrical column 63 provided with an internally tapped bore 64. A threaded post 65 is threadedly secured to bore 64 and to an internally tapped bore 66 in a universal 90 degrees connection 67. The effective height of post 65, i.e. the vertical distance between the bottom of plate 62 and the top of connector 67 is controlably adjusted by nut 68.

90 degree universal connector 67 is provided with a spheroidal cup 69 in which a ball-joint 70 of a hollow connecting rod 71 is disposed. Rod 71 is provided with an internally tapped bore 72. Universal connectors 67, connecting rods 71 and a threaded bar 73 constitute the horizontal bar structure 60. The span between the ends of connectors 67 is adjustably controlled by threading bar 73 into tapped bores 72.

Base plates 62 are provided with fastening apertures 74 to permit securement of the base plate 62 to the tail segments 17, 18 of the monoski 10.

Figure 13:
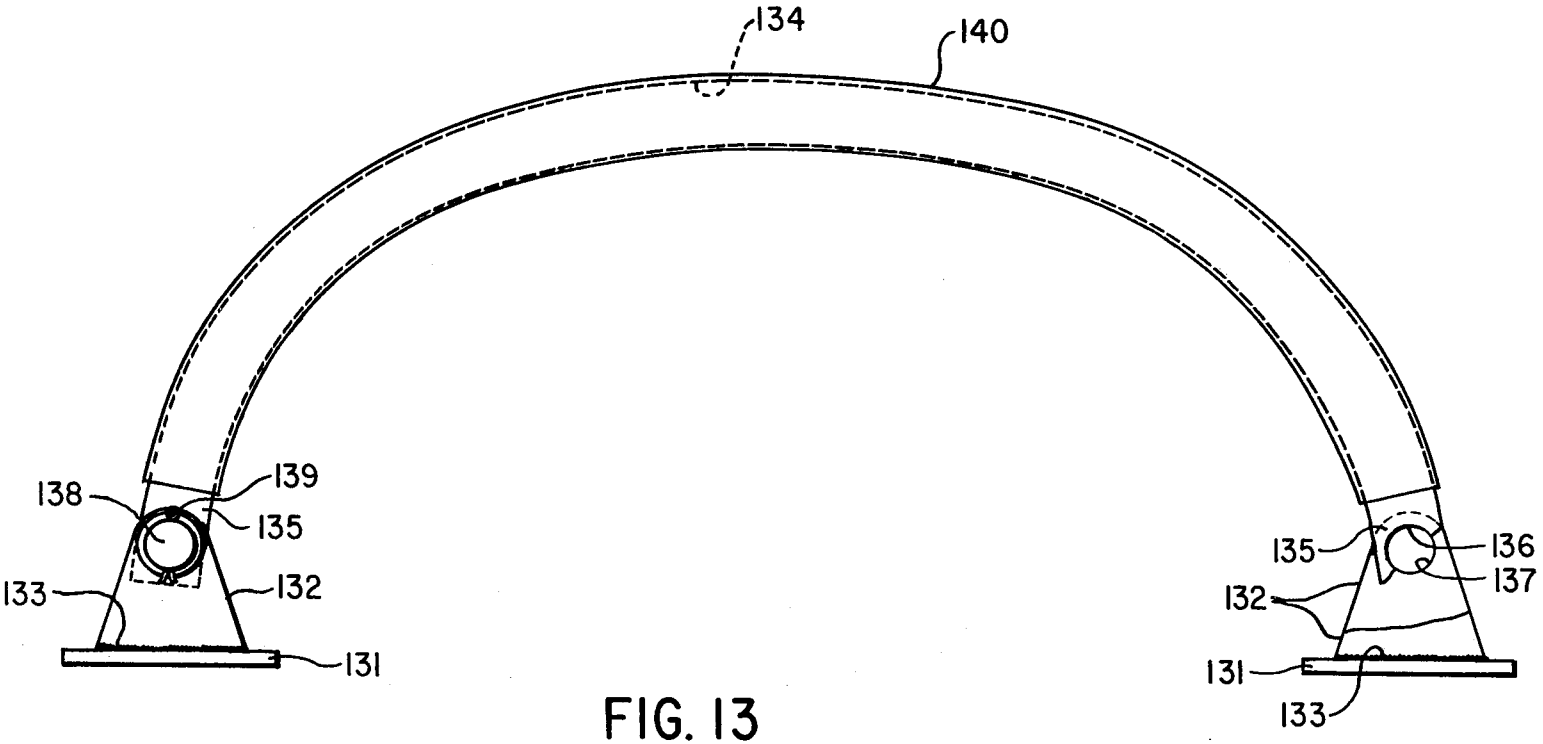
FIG. 13 is a rear end view of one embodiment of an assembled bridge section showing the upper plates, ears and semi-hoop like bridge.

Description of FIG. 13

As seen in FIG. 13, the bridge section includes a pair of top plates 131, to each of which a pair of spaced apart ears 132 are integrally provided, e.g. by welding 133. The bridge comprises a circular rod 134, bent into a semi-hoop shape, the ends 135 of which are each provided with an aperture 136. The ears are provided with aligned apertures 137. A pin 138 passes through apertures 137, 136 to secure the bridge means 134 to the ears 132. The pins 138 is held in place with a washer/cotter pin arrangement 139. The bridge means 134 is covered with a protective rubber wrapping 140.

Figure 14:
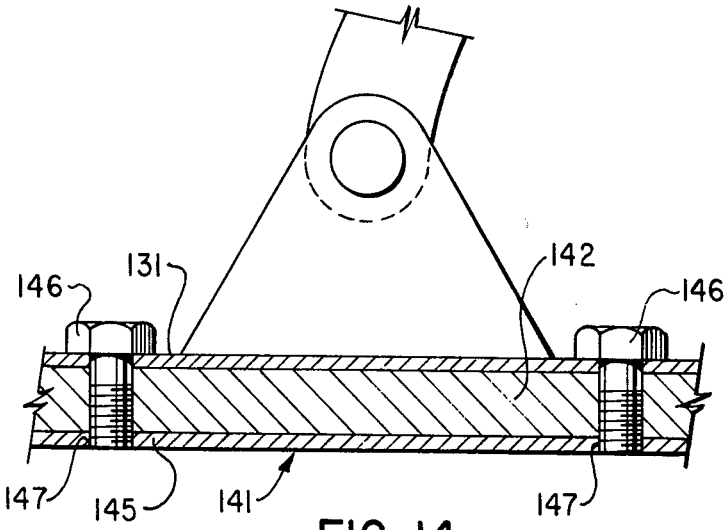
FIG. 14 is a view of a portion of the bridge section of FIG. 13 showing the securement of the upper plate to the twinski.
Figure 16:
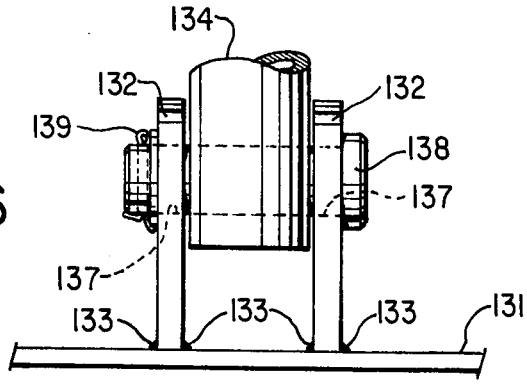
FIG. 16 is a side elevation showing the assembly of the bridge to the ears.

Description of FIGS. 14 and 16

As seen in FIGS. 14 and 16, the tail segment 141 of the twinski is provided with the top plate 131, secured to the ski core 142, where a section of the upper skin 143 of the ski has been removed. (See FIG. 11). A section of the lower skin 144 has also been removed to provide means for insertion of a bottom plate 145. A bolt 146 securing the top plate 131 to the bottom plate 145 passes through the ski core 142 and engages in tapped holes. 147 in the bottom plate.

Figure 15:
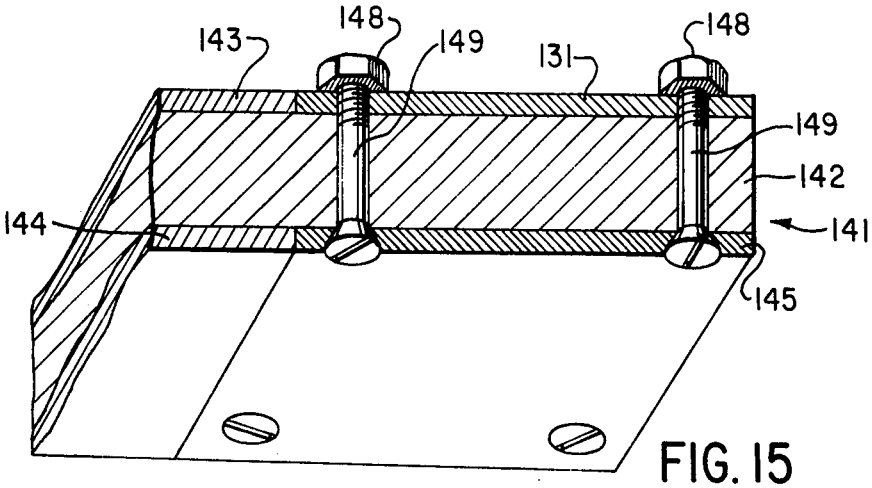
FIG. 15 is a bottom perspective view of the tail segment of the twinski showing a typical assembly of the upper and lower plates.

Description of FIG. 15

Figure 10:
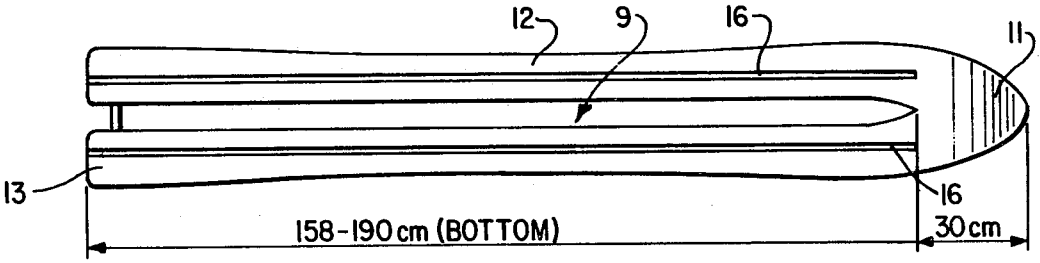

As an alternative procedure for securing the lower plate 145 to the upper plate 131 as seen in FIG. 10, the upper plate is provided with welded-on nuts 148. A screw 149 passes through countersunk holes in the bottom plate 145 to be secured into the nuts 148.

Figure 17:
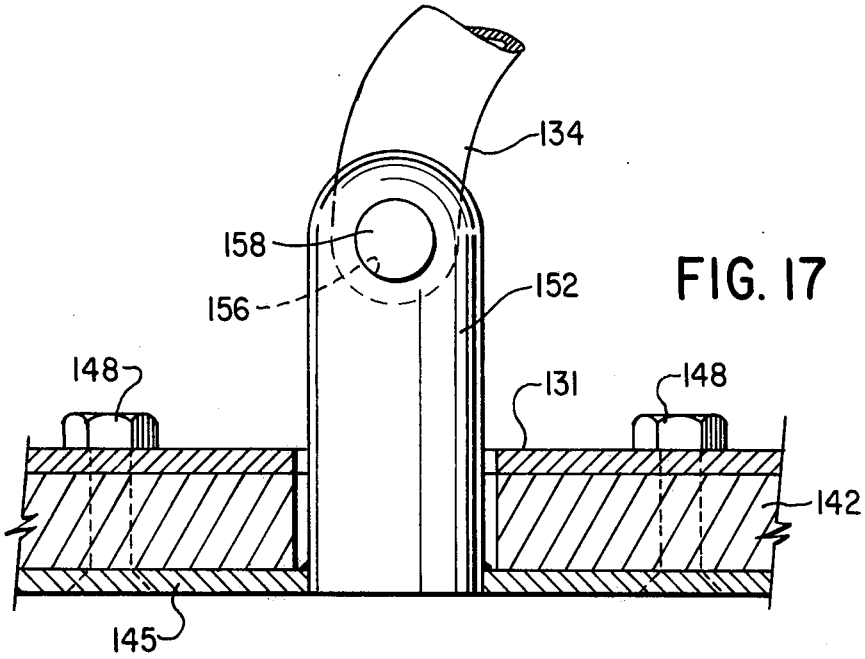
FIG. 17 is a rear end view of a portion of a bridge section of another embodiment of the invention, showing the securement of the twinski.
Figure 18:
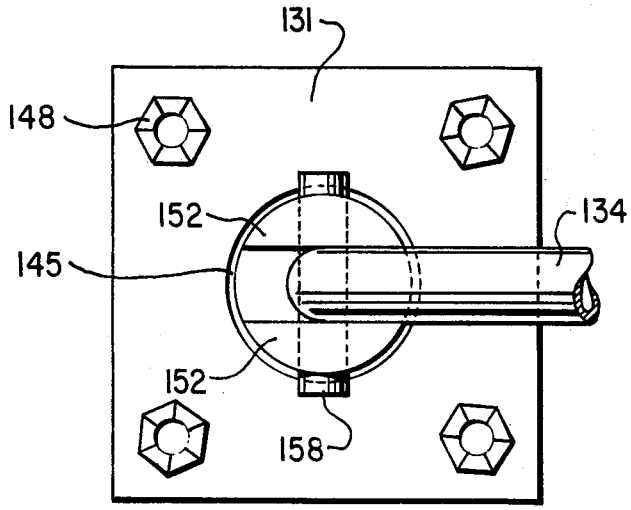
FIG. 18 is a top plan view of the bridge section of FIG. 12.

Description of FIGS. 17 and 18

A further variation is shown in FIGS. 17 and 18. Here the bottom plate is provided with a pair of ears 152 provided with aligned apertures 156 in the same manner as ears 132. The ears 152 pass through apertures 153 in the upper plate 131. The lower end of bridge means 134 is secured to ears 152 by means of pin 158. The upper plate 131 is provided with suitable locknuts 148, made of fiber material, or any other suitable crown nut.

Figure 11:
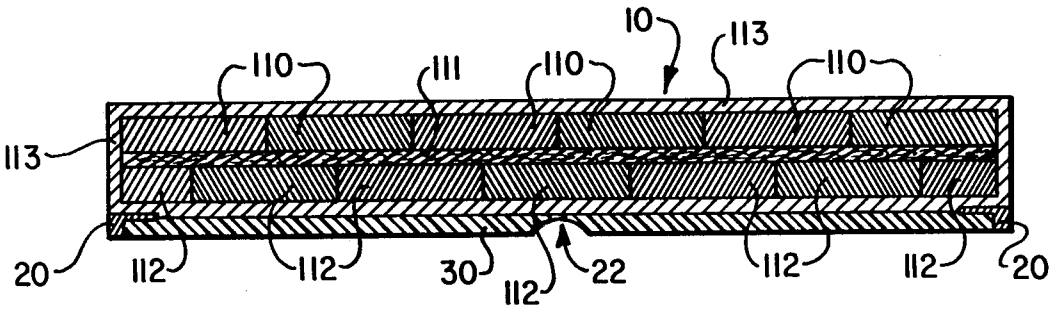
FIG. 11 is a transverse cross-section through the tail section of one embodiment of the twinski according to this invention.
Figure 12:
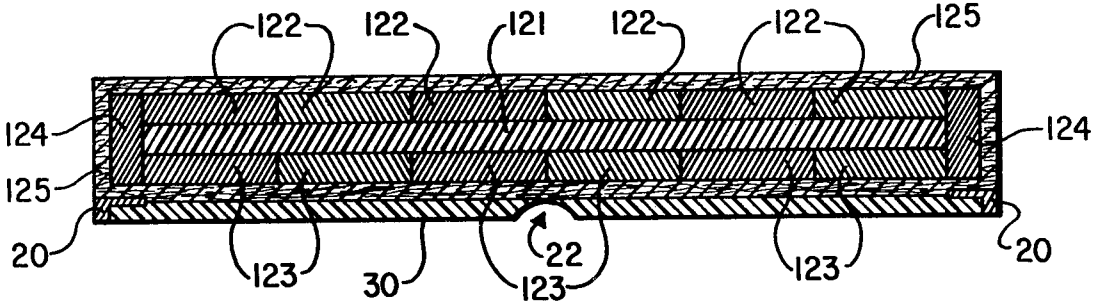
FIG. 12 is a transverse cross-section through the tail section of another embodiment of a twinski of this invention.

Description of FIGS. 11 and 12

The materials out of which the twinski may be made and typical transverse cross-sections of the tail sections 12, 13 of embodiments of this invention are shown in FIGS. 11 and 12. in FIG. 11, it is seen that the core of twinski 10 includes a laminate of edge-glued hickory strips 110, glass-fibre sheet 111 and edge-glued strip 112 enveloped with a sheet of airplane aluminum 113. The running surface 30 is formed of polytetrafluorethylene or any other suitable plastics material, having a single groove 22 therein. The lower side edges are provided with steel edges 20.

In FIG. 12 there is shown a hard foam core 121 with a stiffening layer of edge-glued sheet 122 a lower layer of edge-glued ash sheet 123 and lateral ash strips 124 with an envelope of a sheet of fiberglass 125. The running surface 30 is formed of polytetrafluoroethylene or any other suitable plastics material, having a groove 22 (as disclosed in FIG. 2) therein. The lower side edges are provided with steel edges 20.

While two embodiments of twinski construction have been shown and described, other structures may be used. Thus, the core may be made of aluminum, which is laminated to a facing sheet, e.g. of glass fibre, or of a metal, e.g. airplane aluminum, and then provided with a lower running surface of a plastic material, e.g. polytetrafluoroethylene.

GENERALIZED DESCRIPTION OF EMBODIMENTS OF THE INVENTION

Figure 8:
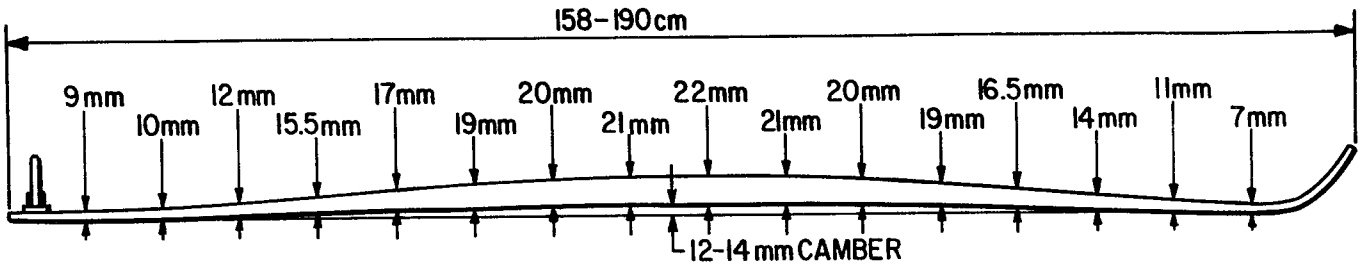
FIGS. 8–10 show dimensional details of the twin ski according to this invention.
Figure 9:
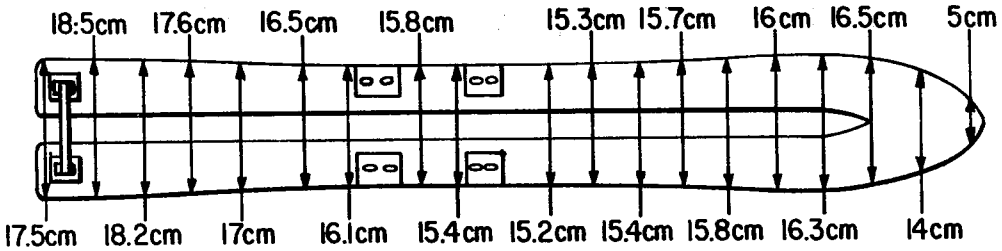

Referring to FIGS. 8–10, the camber at the waist area of each bifurcated tail section may be about ½" to 3/5". The integral mononose tip and the tip region may have a uniform thickness of about ⅛", the thickness may vary to provide a degree of "softness" which can vary for weight variations of skiers. Thus, the tip may taper in thickness to provide a softer tip for a 150 lb. skier or it may be thicker than about ⅓", i.e. it may be greater than ⅓" thick to provide a stiffer tip for a 250 lb. skier.

The twinski may be from about 75" to about 88" long. The grooves may be from about 4/100 to 8/100" wide and may be about 4/100" deep. They may extend from about 11 4/5" from the tip of the ski to the tail edge.

The ratio of the length of the integral mononose portion to the bifurcated tail portion generally is 1:5 to 1:6.5, although other proportions are permissible according to this invention. The width of the slot generally varies between about ¼ and ¾ of the total average width of the twinski 10. Thus the slot may be wider, the same width or narrower than the width of each of the bifurcated tail sections.

As described above, in plan form the twinski is shorter than a conventional ski and is, on the average, approximately three to four times the width. While the exact dimensions may vary to suit the rider and the required performance characteristics, the basic proportions of a tested efficient ski are given below as typical.

In one embodiment, the ski has a length of about 75". The width of the forward tip region is about ½", the width at the central waist area (included tail sections and slot) is about ⅞" and the width at the tail area (including tail section and slot) is at least about 7". The bindings are located about 2" rearward of the center part of the longitudinal axis. They are set to extend from about ¼" to about ½" over the lateral edges of the twinski.

The grooves commence about 13¾" from the forward tip and continue right through to each of the tail sections. The lateral positioning of the longitudinal grooves is approximately one-half of the width of each tail section and the depth is approximately ¾" to 1 1/5". The bottom of the twinski tapers up slightly at the tail portion. In addition, the camber of the twinski is greater than that of conventional skis.

The length of the longitudinal slot is dependent, to some extent, upon the snow the twinski is adapted to be skied upon. For powder snow, the slot extends a lesser distance into the integral mononose tip than for hard packed snow. For example, some typical dimensions for a twinski particularly adapted to be used in hard packed snow are:

Total width at tail: about 9"
- Width of each tail: about 3¼"
- Width of slot segment: about 2½"

Length of slot prior to apex (apex being the point where the sides of the slot converge sharply to join together in the integral mononose): about 68 to 75" (depending on the material of construction of the mononose)

Width of slot prior to apex: about 1⅞" to about 1⅔"

Length of apex of slot: about 2" to about ¾" (depending n width of slot prior to apex)

Width of ski at mid-section (total): about 8⅓"
- Width of slot at mid-section: about 2½"
- Width of ski at mononose: about 8⅓"

Total length of monoski: about 80"

The integral mononose section must be made of exceptionally strong material, e.g. a metal, for example, aluminum, in order to withstand the stress build up on the monoski due to the twisting action at the tail segments. Such twisting action is inherent in the "setting" of the edges of the monoski during skiing. Thus, it is essential that the tip be made very strong in order to avoid breakage. It is thus preferred that the metal integral mononose extend to the bifurcated portion, to a total length of integral mononose of e.g. 20".

Consequently, in a twinski to be used in hard packed snow, the slot converges as it approaches the integral mononose and encroaches a greater distance into the integral mononose. The length of the slot can be varied depending on the material used in the integral mononose region. Thus, for more flexible material, the slot need not be as long in order to provide a twinski which can twist under skiing conditions to "set" the edges.

In another example, for a twinski intended for powder snow, the typical dimensions are as follows:

Total width of monoski at tail: about 10"
Width of each tail segment: about ½"
Width of slot: about 3⅛"
Total width of monoski at mid-section: about 8½"
Width of each mid-section: about 3"
Width of slot: about 2½"
Total width at integral section: about 9⅛"
Length of slot prior to apex: about 60⅝"
Width of slot at prior to apex: about 2"
Length of apex: about 5½"
Total length of monoski: about 81⅔"

In this example of twinski as well, the slot converges towards the integral mononose section. It will be observed that the slot extends into the mononose section to a lesser extent than for the previously described twinski.

Thus, by the present invention, a twinski is provided which is of sufficient width to hold both feet in fairly close side-by-side position in conventional bindings or boot retainers. The twinski has a relatively stiff central waist portion, with a flexible tip region, a flexible, outwardly flared tail and a maximum bottom camber. The relationship of the width at the tip region, at the waist portion and at the tail portion is important to the performance of the ski. Also essential is the "floating" interconnection of the tail sections. This permits each of the bifurcated tail sections to move vertically independently. Moreover, the rear spacing of the tail section is adjustable. Advantages of the twinski provided herein are extreme maneuverability, good pivot turnability, controlled turns at all speeds and good support on powder snow and excellent maneuverability in both packed and corn snow. The four edges provide greater control and the twinski provides a wider stance for balance enabling greater use by a novice. The interconnected tail sections work independently. Moreover, the twinski is lighter and easier to carry.

I claim:

1. A twinski comprising: an integral mononose section and bifurcated tail sections separated by a longitudinal slot, the tail sections being at least five times as long as the integral nose section, the integral nose section including an upwardly curved forward tip region, the tail sections including a pair of central waist segments comprising a central waist portion, and a pair of terminal tail segments comprising a tail portion, said monoski having its greatest thickness at the central waist portion, and being reduced in thickness both towards the tail portion and the forward tip, the minimum thickness being adjacent to said forward tip region; ski bindings adapted to be mounted on each of said tail sections of said ski adjacent said central waist portion for holding the feet of a skier in side-by-side relation; and bridge means at the tail portion adjustably and floatingly holding the tail sections in predetermined spaced apart relation, so that the lateral spacings are predetermined but yet the tail sections are allowed to move vertically.

2. The twinski of claim 1 wherein said bridge means comprises a connector plate secured to the end of each of the tail portions and a single continuous curved connecting rod at its ends secured to a respective one of said connector plates.

3. The twinski of claim 2 wherein the ends of the connecting rod are pivotally connected to their respective connector plate.

4. The twinski of claim 1 wherein said bridge means comprises a connector plate provided with an upstanding post secured to the end of each of the tail portions, and a connector bar interconnecting the upper ends of the upstanding posts.

5. The twinski of claim 4 wherein said connector bar is connected to the posts by a universal joint.

6. The twinski of claim 5 wherein said connector bar is adjustable in length to provide the controlled spacing between the ends of tail portions.

7. The twinski of claim 2 wherein said connecting rod is formed of tension steel.

8. The twinski of claim 1 wherein said bridge means is secured to the tail section by a bottom plate, substituting for a portion of a lower skin of the twinski, and by an upper plate substituting a portion of an upper skin of the twinski.

9. The twinski of claim 8 wherein said bridge means comprises a connecting bar of semi-hoop-like shape, provided with an aperture therethrough at each end, whereby the connecting bar may be connected to spaced apart ears on one of said plates, by means of a pin extending through aligned apertures in the ears and the connecting bar.

10. The twinski of claim 9 wherein the spaced apart ears are welded to the upper plate.

11. The twinski of claim 9 wherein the spaced apart ears are welded to the lower plate, and pass through apertures in the upper plate.

12. The twinski of claim 8 wherein the upper plate is secured to the lower plate by a bolt, passing through the upper plate, the ski core and tapped holes in the lower plate.

13. The monoski of claim 8 wherein the lower plate is secured to the upper plate by screws passing through the lower plate, the ski core and nuts secured around apertures in the upper plate.

14. The twinski of claim 9 wherein said connecting bar is provided with a protective wrapper.

15. The twinski of claim 1 wherein the width of the longitudinal slots is from ½ to 2 times the width of each of the tail sections.

16. The twinski of claim 15 wherein the width of the longitudinal slot is the same as the width of each of the tail sections.

17. The twinski of claim 1 wherein the total width of the tail sections is equal to the width of the tip at the integral mononose section.

18. The twinski of claim 1 wherein each bifurcated tail section is wider than the slot, at the tail.

19. The twinski of claim 1 wherein the slot converges from the tail to the integral mononose.

20. The twinski of claim 19 wherein the degree of convergence increases at the integral mononose.

21. The twinski of claim 19, for use on hard packed snow, wherein the slot extends from about ½ to about 2" into the integral mononose.

22. The twinski of claim 1 which is from about 41⅔" to about 93¾" long.

23. The twinski of claim 1 which is about 80½" long and wherein the integral mononose section is about 20 4/5" long.

24. The twinski of claim 1 wherein the slot is about 66⅔" to about 75" long.

25. The twinski of claim 1 wherein the slot converges from about 2½" to about 1⅔" wide.

26. The twinski of claim 1 which is about 81⅔" long and wherein the integral mononose section is about 18¾" long.

27. The twinski of claim 1 wherein the slot is about 61¼" long.

28. The twinski of claim 23 wherein the slot converges from about 3⅓" to about 2" wide.

29. The twinski of claim 1 wherein the integral mononose section is formed of exceptionally strong material to resist movements of the tail sections.

30. The twinski of claim 1 including a groove in the base of each of the tail sections.

31. The twinski of claim 1 wherein the grooves commence about 11 4/5"–13 4/5" from the forward tip of the ski and extend through each of the tail sections of the ski.

32. The twinski of claim 1 having a camber of about ½" to 3/5".

33. The twinski of claim 1 wherein said bindings are secured to each of said bifurcated tail sections and extend slightly over the side edges thereof.

34. The twinski of claim 33 wherein the bindings extend from about ¼" to ½" over the side edges of the ski.

35. The twinski of claim 1 wherein said bindings include a pair of toe members mounted parallel to one another on individual base plates, each said base plate being secured directly onto a respective tail section of said twinski, and a pair of heel members mounted parallel to one another on individual base plates, each said base plate being secured directly onto a respective tail section of said twinski.

36. The twinski of claim 1 formed of a lamination of a foam core with stiffening members of wood, and a glass fibre sheet envelope with a synthetic plastics material at the bottom, running surface.

37. The twinski of claim 1 formed of a laminate of hickory, ash, and glass fibre, an airplane aluminum envelope, with a bottom running surface of a synthetic plastics material.

38. The twinski of claim 1, including four steel running edges along the edges of the tail sections of the monoski.

39. The twinski of claim 1, including four running edges of a hard plastics material, selected from polyurethane or nylon along the edges of the tail sections of the monoski.

* * * * *